United States Patent [19]

Grant et al.

[11] Patent Number: 4,579,587

[45] Date of Patent: Apr. 1, 1986

[54] METHOD FOR PRODUCING HIGH STRENGTH METAL-CERAMIC COMPOSITION

[75] Inventors: Nicholas J. Grant, Winchester, Mass.; Charles H. Smith, Schenectady, N.Y.

[73] Assignee: Massachusetts Institute of Technology, Cambridge, Mass.

[21] Appl. No.: 695,669

[22] Filed: Jan. 28, 1985

Related U.S. Application Data

[63] Continuation of Ser. No. 523,515, Aug. 15, 1983, abandoned.

[51] Int. Cl.[4] ..... C22C 1/00

[52] U.S. Cl. ..... 75/0.5 R; 75/0.5 BA; 75/0.5 BB; 75/0.5 C; 264/12; 419/62; 419/66; 241/15; 420/590

[58] Field of Search ..... 75/0.5 R, 0.5 C, 251-255, 75/230, 232, 233, 0.5 BB, 0.5 B, 0.5 BA; 148/410; 264/6, 10, 12; 241/15; 419/32, 33, 62, 66, 19, 20; 420/590

[56] References Cited

U.S. PATENT DOCUMENTS

| | | | |
|---|---|---|---|
| 3,028,234 | 4/1962 | Alexander | 420/590 |
| 3,269,825 | 8/1966 | Vordahl | 420/590 |
| 3,591,362 | 7/1971 | Benjamin | 75/251 |
| 3,912,552 | 10/1975 | Schultz et al. | 148/31 |
| 3,922,182 | 11/1975 | Merrich | 148/410 |
| 3,926,568 | 12/1975 | Benjamin et al. | 29/182.5 |
| 3,992,161 | 11/1976 | Cairns et al. | 29/182.5 |
| 3,995,815 | 12/1976 | Megelas | 241/15 |
| 4,010,024 | 3/1977 | Baranow | 75/0.5 BC |
| 4,069,045 | 1/1978 | Lundgren | 75/251 |
| 4,300,947 | 11/1981 | Habesch | 75/0.5 R |
| 4,315,777 | 2/1982 | Nadkarni et al. | 75/232 |
| 4,343,650 | 8/1982 | Rivers | 75/213 |
| 4,386,976 | 6/1983 | Benn et al. | 148/410 |

*Primary Examiner*—Christopher W. Brody
*Attorney, Agent, or Firm*—Paul J. Cook

[57] ABSTRACT

Metal powder-oxide compositions are provided suitable for forming high strength composite products. The compositions comprise powdered flake-like metal alloys having a thickness between 0.5 and 2 microns wherein the oxide comprises between 0.5 and 5 weight percent of the composite compositions.

10 Claims, No Drawings

METHOD FOR PRODUCING HIGH STRENGTH METAL-CERAMIC COMPOSITION

BACKGROUND OF THE INVENTION

The Government has rights in this invention pursuant to Contract Number DAAG29-81-K-0035 awarded by the U.S. Army.

This application is a continuation of Application Ser. No. 523,515 filed Aug. 15, 1983, now abandoned.

This invention relates to a method for producing novel high strength metal-ceramic compositions.

There is a perpetual need for alloys which retain their high strength characteristics for very high temperature service for long periods of time. Presently nickel and cobalt base superalloys are usually restricted in use to a temperature environment up to about 1000° C. For higher temperature environments, after refractory metals and alloys, notably those based on niobium and molybdenum, failed to meet the service requirements in these high temperature environments, the oxide dispersed alloys and oxide dispersion strengthen alloys, based usually on nickel and cobalt, have offered the best performance at temperature environments between 1000° C. and 1200° C. Whereas the oxide dispersed nickel and cobalt based alloys meet performance requirements, they are unusually expensive because of the complex, drawn out, batch-type preparation techniques which they require.

It has been proposed to combine base metals and alloying elements with refractory oxide phases by a process of cold mechanical alloying of a particular refractory oxide with a mixture or blend of elemental metals and selected master alloy compositions to achieve uniform malleability in a process which utilizes attrition and/or ball mill grinding in an inert atmosphere. Elements such as chromium, molybdenum and tungsten are brittle and crush into superfine dust and may not mix well. Metals such as titanium or zirconium are reactive and interact unfavorably with certain other elements, including oxygen and nitrogen and carbon. Aluminum, for example, is very soft, highly reactive, and has a very low melting temperature so that uniform mixing of the pure metal with the refractory oxide is very difficult to achieve. Even when relatively satisfactory mechanical alloying is obtained, the production of the master alloys for optimum blending is quite expensive and the subsequent cold alloying is slow. Because this process is a cold welding, cold alloying process, grinding times are also very long and expensive. With these products, excellent mechanical properties and alloy stabillity are obtained; however, the products and process suffer several defects. First, it is very difficult to reproduce the intricate alloys for the complex alloy blend, and then to reproduce the structure and properties of given alloy-ceramic compositions. In addition, scale-up for large batch or for continuous processes is a very serious problem. Finally, special master alloys for complex alloys entail extremely high cost of production.

Accordingly, it would be highly desirable to provide a process for forming metal-metal oxide compositions which are capable of producing such compositions that withstand high temperatures for long periods of time during use. In addition, it would be highly desirable to provide a process which produces such compositions that reproduceably form products of the same structure and properties, are capable of being scaled-up for large batch or continuous operation, and which eliminate the need for expensive special master alloy compositions.

SUMMARY OF THE INVENTION

In accordance with this invention, a process for forming metal-metal oxide compositions is provided. The basic process of this invention comprises four steps. In the first step, the fully alloyed master alloy (of almost any degree of complexity) is rendered molten and can be produced from conventional, commercial metals and alloys, including scrap. The size and shape of the metals and master alloys and of the scrap is not important or a limitation. The resultant molten alloy then is atomized by rapid solidification techniques, achieving solidification rates of at least $10^{2}$° C./sec to form a fine powder of between about 1 and about 250 microns, preferably between about 1 and about 100 microns and optimally from 1 to 50 microns, thereby to produce the basic metal alloy composition in the form of spherical powders. The fine powder then is converted to flakes in a (protective) atmosphere, such as ethanol, by attrition with hardened metal balls to produce an average flake thickness of between about ½ and about 2 μm. The ceramic composition in the form of powders having a size between about 0.05 and about 0.2 microns is then added to the metal alloy flake and the resultant mixture is ball milled in an inert atmosphere in order to cause the smaller oxide particles to become incorporated into the metal alloy powder homogeneously. The resultant composition then can be compacted and hot extruded to form the desired composition of desired shape. Other hot compaction techniques can be used.

DESCRIPTION OF SPECIFIC EMBODIMENTS

The compositions of this invention are produced in a four step process. In the first step, the metal constituents of the desired alloy are melted. The sources of the metal constituents for the master alloy are not critical and can include, for example, scrap metal. The molten composition then is atomized in an inert atmosphere under conditions that the atomized liquid particles are rapidly solidified, for example, at a rate of at least 100° C. per second in order to form solidified powders each having a very finely structured homogeneous composition. The rapid solidification permits obtaining powders which are free of major segregation and coarse secondary powders. Because the powders are homogeneous, the physical properties are enhanced, for example, alloy plasticity. The atomized powders are fully alloyed with the exception of the refractory oxide powder material which is incorporated subsequently. The molten master alloy can be atomized in any convenient manner which provides solidification rates in excess of about $10^{2}$° C./sec. Ultrasonic gas atomization, certain centrifugal atomization processes, some subsonic gas atomization processes and others, are all capable of achieving the quench rates.

If we use the ultrasonic gas atomization process, or other similar high gas velocity processes, the sequence of steps to produce rapidly solidified, fine, fully alloyed powders is as follows. The alloy, of selected final metallic composition is placed in a ceramic crucible which, in turn, resides in an induction heating coil. The coil, crucible and alloy charge are within a large stainless steel chamber which is the atomization chamber. The system is sealed from the atmosphere, with necessary thermocouple arrangements for reading temperatures, pressure gauges, stopper rods, pouring tubes, etc. The alloy is melted, usually in a vacuum, and held at a temperature of about 100° to 150° C. above the melting temperature to homogenize the molten alloy. The tank is then pressurized with an inert gas, usually argon or helium. The metal is then poured through the atomization nozzle (die) where it is impacted by many converging gas jets of high velocity gas (generally argon or helium) to accomplish the atomization. With the ultrasonic gas atomization unit, a high yield of minus 53 micron spherical powders is achieved (usually in excess of 70%), and up to 80 to 85% of minus 100 microns. These powders are of a highly refined structure, segregation of alloying elements and phases is slight, and for alloy IN-100 and comparable Ni- and Co-base superalloys the powders are quite ductile, a desired prerequisite for the attritor flaking step. Generally, the powders produced by preferred atomization techniques have a size between about 1 and about 250 microns, usually between about 1 and about 100 microns with high yield of useful powders.

It has been found, in accordance with this invention, that prior to incorporating the oxide powder into the metal particles, it is necessary to reduce the size of the metal particles so that the oxide powder can be incorporated therein uniformly. If the metal particles are too thick or spherical, the time needed to ball mill the mixture of metal powder and ceramic powder in order to achieve uniform incorporation of the ceramic powder is too long, may not be achieved at all or may result in the production of coarse welded agglomerates. On the other hand, if the metal powders are too small, they also will cause production of excess metal fines during ball milling with the ceramic powder. Therefore, it is necessary, in accordance with this invention, to convert the atomized metal powder (which have a diameter of 1 to 100 microns) into flake-like particles which have a thickness of only 0.5 to 2 microns. This can be achieved by placing the atomized metal powders into an attritor such as a Azegvari Attritor. The atomized metal powders then are mixed with hardened metal balls such as hardened steel balls together with a liquid which prevents oxidation during attrition, such as ethanol or isopropyl alchol or the like. The time of attrition will depend upon the plasticity and hardness of the metal powders and usually is between about 6 and about 12 hours. In any event, it is necessary to obtain a resultant average flake with thickness of between about 0.5 and about 2 microns, preferably between about 0.5 and about 1 micron.

The metal flake particles obtained by attrition then are ball milled together with the selected refractory powdered oxide in an inert atmosphere in order to homogeneously incorporate the ceramic fine oxides into the metal powders. Generally, the ceramic powders have a particle size of between about 0.05 and about 0.2 micron, preferably between about 0.02 and 0.1 micron. Representative, suitable ceramic materials include yttrium oxide, beryllium oxide, thorium oxide, alpha aluminum oxide, refractory oxides which are free of phase transformations, within the contemplated temperature range of application. The ceramic powders can be incorporated into the metal powders at a weight ratio between about 0.2 and about 5%, preferably between about 0.5 and about 3% so that the resultant composition can be completed by hot extrusion, hot isostatic pressing, and can further be formed into useful shapes for use in high temperature environments for extended periods of time.

The compositions of this invention can be formed from any ductile metal alloy essentially regardless of its chemical composition. Representative suitable alloys include lead alloys, magnesium alloys, zinc alloys, aluminum alloys, copper alloys, iron alloys, nickel alloys, cobalt alloys, titanium, zirconium, niobium, molybdenum, tantalium and tungsten alloys. Examples of these alloys are zinc-aluminum alloys, zinc-copper alloys, magnesium-aluminum alloys, magnesium-aluminum-zinc alloys, aluminum-copper alloys, aluminum-silicon alloys, aluminum-copper-zinc-magnesium alloys, copper-tin bronzes, brass, aluminum bronzes, steels, tool steels, stainless steels, superalloys, cobalt-chromium alloys, etc.

The thus-produced compositions of this invention can be consolidated and shaped conveniently, for example, by first packing the composite blended powder in a closed container (a can) which is then evacuated at a pressure of about 1 to 50 microns, preferably less than about 10 microns. While the vacuum is maintained, the container and composite powders are heated to a hot extrusion temperature and extruded typically at reduction ratios (area) of between about 8 and about 40 to 1, preferably between about 16 and about 30 to 1. Other methods for forming the composite powders of this invention which can be utilized include hot isostatic pressing, hot mechanical pressing or closed die forging.

The resultant metal-ceramic superalloys obtained by the process of this invention are capable of operating at temperatures up to about 1200° C., about 50° to 200° C. higher in temperature as compared to the non-ceramic containing alloys without any significant decrease in operating stresses. Thus, the formed metal-ceramic compositions of this invention can be used typically in jet engines, gas turbines, fusion reactors, high temperature chemical processing systems or the like.

The following examples illustrate the present invention and are not intended to limit the same.

EXAMPLE I

This example illustrates the process for forming a composite composition from Ni-20 Cr-20 Co-10 Mo containing between about 1 and 5 weight percent yttrium oxide.

A composition of alloy containing (in weight percent) 20% Cr, 20% Co, 10% Mo, 0.5% Mn, 0.02% C, balance Ni, a solid solution single phase alloy was prepared from pure elemental metals by induction melting in an inert atmosphere. The molten alloy was cast into 2-inch diameter bars which are suitable for charging and remelting for atomization. About 10 lbs. of alloy were prepared. The remelt alloy bar was placed into the induction melting furnace in the atomization chamber; the chamber closed and evacuated to about 50 microns vacuum, after which the alloy was melted. Once molten, it was held for 30 minutes at 1575° C. to homogenize the melt. At this point, the chamber was back filled with argon; the stopper rod was pulled allowing the molten alloy to pass through the atomization die where it was atomized with high velocity argon gas. The dendrite arm spacing of the powders indicated a solidification rate of $10^{4}$° C./sec. The fraction finer than 53 microns was separated and attritor milled using a charge of 250 grams of fine powder which was added to the steel ball charge in the one-gallon container, along with enough ethanol to cover the balls and powder charge.

After periodic tests of the powder as it was ground to fine flakes, it was determined that the flakes were between about 0.5 and 1.5 microns in thickness. It took 12 hours of grinding to achieve this fine flake size. The alcohol was decanted, then the balance was evaporated. The fine alloy flakes were mixed with 4% of yttrium oxide which had a powder size between 0.02- and 0.05 microns. The mixture was placed into a ball mill with appropriate ball charge and sealed off with an inert gas atmosphere. Grinding and blending took 6 hours.

The blended alloy-plus-oxide mix was checked metallographically to determine if the oxide was uniformly blended into the metal alloy. The alloy-plus-oxide blend was then cold compacted at 60,000 psi into a mild steel can; the can was sealed with a cover plate containing an evacuation tube. A vacuum of 10 microns was pumped overnight, with the can being heated in the final stages. The can was heated to 600° C., held at that temperature for 2 hours, and weld sealed. After this, the evacuated can assembly (2.75 inch diameter) was heated to 1100° C., the hot extrusion temperature, held at temperature for one hour, and hot extruded at 1100° C., at a pressure of 800 tons. The final extrusion ratio was 30:1 (area reduction) and the bar size was 0.5-inch round.

EXAMPLE II

This example illustrates the formation of a 316 austenitic stainless steel containing between about 1 and 5 weight percent yttrium oxide.

A commercial alloy of the 316 stainless type was purchased as wrought bar stock of 2-inch diameter. About 10 lbs. of the alloy was melted in the atomization chamber as was done in Example I. The alloy was held at 1600° C. for 30 minutes, after which the evacuated chamber was argon repressurized and the molten alloy was atomized as in Example I. The solidification rate was indicated to have been $10^{4}$° C./sec.

Again the minus 53 micron powders were attrited in the same way as was the Ni-Co-Cr-Mo alloy in Example I. After 10 hours, the flake thickness was measured to be between 0.5 and 2 microns.

This flake product was mixed with 5 weight percent yttrium oxide which had a powder diameter between 0.1 and 0.5 microns, and ball milled for 8 hours. The blended alloy plus yttria were charged into a mild steel can (2.75 inch diameter) and underwent the same steps of evacuation, heating, sealing, and heating to the extrusion temperature, which was 1050° C. The extrusion ratio was 20:1 (area reduction); the running pressure during extrusion was 280 tons. The final product was 0.5-inch diameter bar.

EXAMPLE III

This example illustrates the formation of a composite of alloy IN-100, a nickel base superalloy and between 1 and 5 weight percent yttrium oxide.

Specially prepared, vacuum melted bar was obtained from special Metals Co. in the form of 2-inch round cast bar. The alloy was sent to Osprey Metals Co. of England who have a high velocity gas atomization process which achieves solidification rates of at least $10^{4}$° C./sec. It was planned to have a different source of atomization compared to Examples I and II to demonstrate the utility of other atomization processes, provided that a quench rate greater than about $10^{2}$° C./sec is achieved during atomization of very highly alloyed materials such as IN100.

A quench rate of $10^{4}$° C./sec was achieved. The powders were slightly coarser than in Examples I and II; accordingly, powders finer than about 65 microns were used for the attrition process. Again, attrition was completed after about 8 hours of flaking when the flakes were between about 0.5 and 1.5 microns.

The flaked IN-100 was blended with 5 weight percent of yttrium oxide of powder size between 0.05 and 0.2 microns and ball milled for 36 hours. As in the previous two examples, the alloy-plus-yttria blend was canned in a mild steel can (2.75 inch diameter), evacuated, heated, sealed, and extruded at 1150° C. at an extrusion ratio of 20:1 (area reduction) because of the much higher alloy content of the two-phase ($\gamma+\gamma'$) IN-100 alloy, a higher extrusion temperature and a lower extrusion ratio were used to avoid stalling the extrusion press. Half-inch bar stock was produced of excellent quality.

We claim:

1. A process for making a metal-refractory oxide composite powder comprising the steps of:

melting a metal alloy into a molten state;

atomizing said molten metal into liquid particles and rapidly solidifying said liquid particles at a cooling rate of at least 100° C. per second to form a substantially homogeneous metal powder;

converting said metal powder into flake-like particles ranging in thickness from about 0.5 to 2.0 microns; and mechanically incorporating refractory oxide particles into said flake-like metal particles to form a composite powder, said refractory oxide particles representing a ratio of up to about 5.0 weight percent of said composite powder.

2. A method for making an article comprising a metal-refractory oxide composite, said method comprising the steps of:

melting a metal alloy into a molten state;

atomizing said molten metal into liquid particles and rapidly solidifying said liquid particles at a cooling rate of at least 100° C. per second to form a homogeneous metal powder;

converting said metal powder into flake-like particles ranging in thickness from about 0.5 to 2.0 microns;

mechanically incorporating refractory oxide particles into said flake-like metal particles to form a composite powder, said refractory oxide particles representing a ratio of up to about 5.0 weight percent of said composite powder; and consolidating said composite powder to form an article of predetermined shape.

3. The process of claim 1 or 2 wherein said refractory oxide particles range in size from about 0.05 to 0.2 microns.

4. The process of claims 1 or 2 wherein said refractory oxide particles represent a ratio of about 0.5 to 3.0 weight percent of said composite powder.

5. The process of claim 1 or 2 wherein said metal alloy is stainless steel.

6. The process of claim 1 or 2 wherein said metal is a cobalt nickel-chromium alloy.

7. The method of claim 1 or 2 wherein said refractory oxide powder is yttrium oxide.

8. The method of claim 1 or 2 wherein said refractory oxide powder is beryllium oxide.

9. The method of claim 1 or 2 wherein said refractory oxide powder is thorium oxide.

10. The process of claim 1 or 2 wherein said metal powder is converted to flake-like particles by attrition and said flake-like particles are incorporated with refractory oxide particles by ball milling.

* * * * *